United States Patent [19]

Alinder et al.

[11] 4,105,169

[45] Aug. 8, 1978

[54] MEASURING AND CUTTING APPARATUS FOR FLOOR COVERING

[76] Inventors: Gilbert L. Alinder, 17029 Fiesta Ct., Sun City, Ariz. 85351; Lloyd E. Anderson, 6408 76th Ave. North, Brooklyn Park, Minn. 55428

[21] Appl. No.: 761,639

[22] Filed: Jan. 24, 1977

[51] Int. Cl.[2] ..... B65H 19/20

[52] U.S. Cl. ..... 242/56 R; 242/86.52

[58] Field of Search ..... 242/56 R, 67.1 R, 67.3 R, 242/86.5 R, 86.52

[56] References Cited

U.S. PATENT DOCUMENTS

| | | | |
|---|---|---|---|
| 2,595,593 | 5/1952 | Manning | 242/56 R |
| 2,834,558 | 5/1958 | Halpin | 242/56 R |
| 3,374,964 | 3/1968 | Carvotta | 242/86.52 |
| 3,931,940 | 1/1976 | Raighn | 242/56 R |

*Primary Examiner*—Edward J. McCarthy

*Attorney, Agent, or Firm*—Schroeder, Siegfried, Ryan, Vidas & Steffey

[57] ABSTRACT

A measuring and cutting machine for floor covering which is portable and adjustable to accommodate varying widths of carpet and which is articulated or pivoted along its extent for ease in movement through crowded locations. The improved measuring and cutting machine may be brought to the site of large carpet rolls to measure and cut from the rolls without requiring movement of the rolls to a measuring and cutting area. The improved machine may make use of in addition a flotation principle which aids in movement of the floor covering through the machine to enable operation of the machine by a single operator.

9 Claims, 6 Drawing Figures

MEASURING AND CUTTING APPARATUS FOR FLOOR COVERING

This invention relates to a portable measuring and cutting machine for floor covering and more particularly to an improved machine of this type for handling and cutting of floor covering materials of varying widths in any desired location and with means to permit ease in handling of the floor covering material in the machine.

PRIOR ART

Apparatus for handling of floor covering, such as carpeting and linoleum, have generally been restricted to "in place" machines. They include structure for handling the bulk rolls, unwinding the same, measuring the floor covering to be taken therefrom, apparatus for cutting of the floor covering to the desired length, rerolling the cut length of floor covering and wrapping the same. The physical size of such machines requires relatively large storage spaces, special machinery for handling of the large floor covering rolls to be loaded on and unloaded from the machine, and a plurality of people for operating the same. As such, their use has been restricted to large installations with special handling equipment. Typcial machines of this type are shown in the patents to Keesling et al. U.S. Pat. No. 3,537,662, dated Nov. 7, 1970, entitled FABRIC CUTTING AND MEASURING MACHINES; K. P. Lee U.S. Pat. No. 3,228,620, dated Jan. 11, 1966, entitled YARDAGE COMBINE; AND F. A. Malone U.S. Pat. No. 3,386,678, dated June 4, 1968, entitled ROLL WINDING APPARATUS. Such equipment, because of its size, is restricted to particular types of installation and is not available for use in the smaller carpet or floor covering warehouses wherein carpet may be stored in a number of locations and in which it is desired to have a machine which may be moved to any one of a number of locations for removing desired quantities of floor covering from specific rolls.

Certain types of these machines have been made movable or portable, but their operation has been primarily limited to linoleum type floor covering because of the reduced weight and bulk of the same. An example of such a machine is shown in the Manning U.S. Pat. No. 2,595,593 dated May 6, 1952, entitled MACHINE FOR MEASURING, CUTTING AND ROLLING LINOLEUM. In this particular structure, application of the same is restricted to use in connection with the wall mounted bulk rolls and the measuring and cutting is done offset from the top of the machine upon which the measured floor covering is rolled. This type of apparatus cannot be successfully used with floor coverings of a heavier weight, such as carpet, because of the difficulty in handling the same. Similarly, the size of the measured roll is restricted and while such a machine may be adjusted for varying widths of the linoleum material, use of machine is limited to this specialized application.

THE INVENTION

The present invention is directed to a portable measuring and cutting machine which is suitable for handling all types of floor covering which are manufactured and sold in bulk rolls. The improved machine will measure and cut various widths of floor covering from 6 feet, 12 feet to 15 feet widths, for example. The improved measuring and cutting machine is formed of two table members which are hinged together with each table member having a wheeled end support at each end of the same. When unhinged, the machine may be readily moved through a crowded store site to various locations for desired cutting. Each table member has a set of rollers across one edge of the same with a flat table top and roller members across the opposite edge of the same. One table has a control and drive motor geared to a drive mandrel mounted at one end of the same and supported by one end support. The opposite table has a freely journaled mandrel positioned on the opposite end support. A square ended shaft having a telescopic section is positioned between the mandrels which are generally V-shaped in form and have cooperating V-shaped clamping plates removably attached thereto to secure the shaft to the mandrels. The shaft is rotated through the drive mandrel to roll up the floor covering thereon. Beneath each table and pivotally mounted to the end supports of the same are guide plates which pivot to a position beneath the shaft to aid in handling of the carpet as it is initially fed on to the shaft. One table mounts a measuring device and a set of guide members near one end of the same so that the floor covering may be drawn through the measuring device and guided on the table by the guide members. The second of the tables, remote from the drive mandrel, and measuring device, includes a telescopically mounted end support which may be extended beyond the end of the table when lengths such as 15' beyond the normal 12' length of both tables are required. The end supports on each table member have suitable threaded ground engaging clamps to secure the table in position when operating. In one embodiment, an air floation system is included in the tables which includes an air supply chamber beneath the tables and apertures through the table tops to float the floor covering material and provide for ease in movement of the same through the measuring device and across the tables. This aids in both starting and during the measuring operation on the table. The improved measuring and cutting table is therefore adaptable for use as a single table, a pair of tables, or with the extension to accommodate the varying floor covering widths, and the mandrels are operated to move the carpeting across the table through the measuring device and roll up the measured carpeting. A suitable guide tube is positioned across the table and a removable cutting knife is moved through the tube to be guided across the table on either side of the carpeting so that the severing knife severs the carpet. Suitable clamp down members adjustably positioned on the table secure the carpeting for cutting.

Therefore, it is an object of this invention to provide an improved portable measuring and cutting machine for floor coverings.

Another object of this invention is to provide a portable and sectional pivoted machine of this type for ease in movement in crowded places.

A further object of this invention is to provide an improved measuring and cutting machine for floor coverings which will handle varying widths of covering material.

A still further object of this invention is to provide a machine of this type which may be operated by a single individual.

Another object of this invention is to provide an improved machine of this type with a flotation system included in the top of the tables of the machine for ease in handling the material drawn across the same.

Another object of this invention is to provide an improved measuring and cutting machine which may be utilized to remove floor covering from rolls mounted in wall installations, on table type roll mounting members, on mobile lifts or supported upon braces attached to the machine.

A further object of this invention is to provide in a machine of this type a simplified wrapping arrangement for the measured floor covering.

It is also an object of this invention to provide a machine of this type which is relatively low in cost, yet accurate in measurement and roll up and easy to use.

These and other objects of this invention will become apparent from a reading of the attached description together with the drawings wherein.

Figure 2:
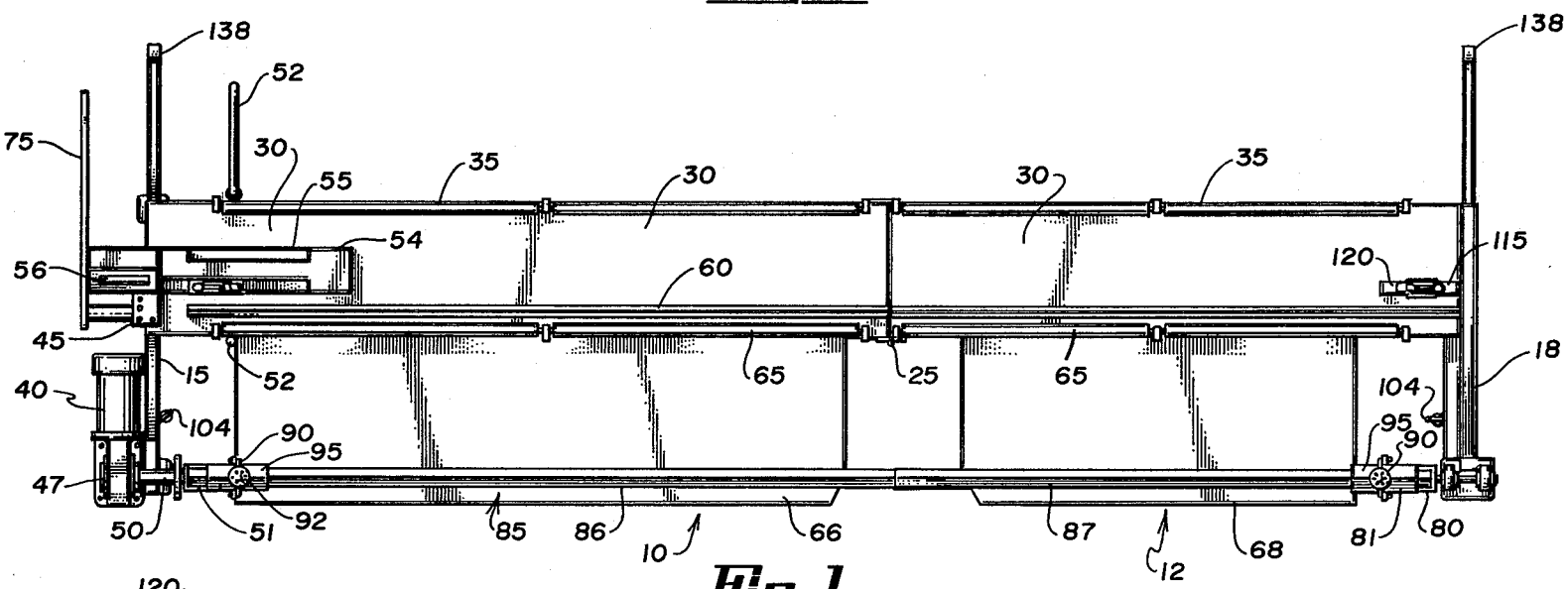
FIG. 2 is a plan view of the machine of FIG. 1.
Figure 1:
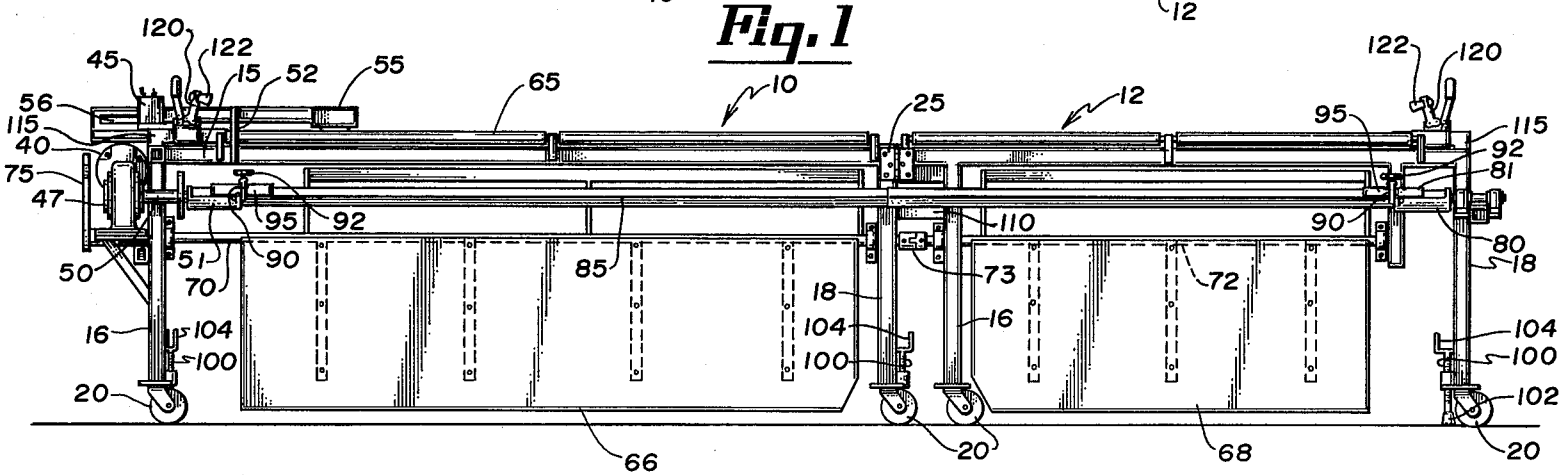
FIG. 1 is a front elevation view of the cutting and measuring machine.
Figure 3:
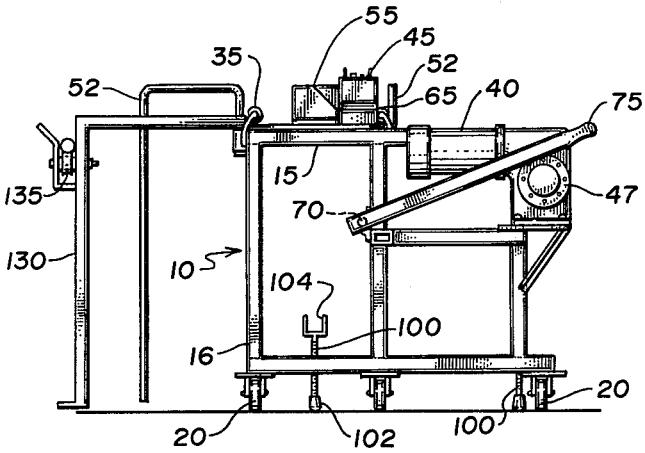
FIG. 3 is a right end elevation view of the machine of FIG. 1.

The improved measuring and cutting table for floor covering, as shown in FIGS. 1, 2, and 3, includes a pair of table members 10 and 12 which are hinged together to provide an elongated machine suitable for cutting standard 12 feet carpet or floor covering widths. Each of the tables is constructed with a tubular metal frame structure 15 having end supports 16 and 18 formed integral therewith and depending therefrom, the end supports having wheels or roller members 20 suitably journaled thereon for portability and transport purposes. The tables are connected by a connecting hinge 25 which is positioned near the top of the frame structures facing the sections with a suitable loose pin to permit separation of the same. The frames are generally square metal tubing welded together with suitable cross bracing and defining a generally rectangular top upon which is positioned a table top 30 and suitably secured thereto. Each of the tables have a set of guide rollers 35 positioned at one edge of the same, extending above the table top to facilitate movement of the floor covering across the same. Table 10 has a drive motor 40 secured to the end support 16 with a suitable control box 45 mounted on the table frame adjacent the table top, the control box having suitable switches and control knobs for operation of the motor. Motor 40 has a gear box 47 connected thereto leading to a drive shaft for a drive mandrel 50 which is journaled in the end support 16 and positioned below the level of the table top and to one side of the same. Located adjacent the control box 45 on this end of the table end are a plurality of guide members 52 which are aligned across the width of the table and define the location of the edge of the floor covering to be moved thereon. A suitable insert 54 is positioned on this end of the table and a measuring unit 55 is mounted thereon having a suitable indicator 56 connected thereto. The measuring unit manufactured by the Trimpitie Co., Ltd, of Radcliff, N.Y., is identified as Model 70KTX. It has a slotted opening therein through which the carpeting or floor covering is inserted to move between measuring rollers which operate a resetable indicator 56 positioned on at one end of the measuring unit 55. Extending along the length of each table and aligned on the table, is connected a cutting guide or tube 60 which is positioned remote from the roller guides 35 and back from the opposite edge of the table. On this edge is positioned another set of roller guides 65 which extend above the level of the table at approximately the same height as the cutting guide or tube 60. Positioned beneath each table are guide plates 66 and 68 which guide plates are each mounted on a shaft 70 and 72 which are journaled respectively in the end support sections 16 and 18 of the tables 10 and 12. The end of shafts 70, 72 have a spline coupling 73 thereon which ties the shafts 70, 72 together to couple the shafts when the tables are in a connected position. The end of shaft 70, projecting beyond the end support 16 of table 10, has a suitable handle 75 connected thereto which handle moves the shaft and hence the guide plates 66, 68 from a position depending beneath the table to one relatively horizontal with the table top. Suitable brackets 76, and 77 hold the handle in its two operating positions. Motor 40 on this end of the table has its controls 45 positioned on the top of the table so that the operator may control the speed of the motor and hence the rotation of the drive mandrel which moves the floor covering across the table and through the measuring device and wraps the same on the shaft. A suitable floor switch (not shown) is associated with the table top controls for ease in operation of the same. The mandrel 50 has a V-shaped notch member 51 at the extremity of the same. A driven mandrel 80 is mounted on the end support 18 of table 12 remote from the controls, and is similarly journaled in the end support, the mandrel 80 also having a similar notch 81 therein. A square ended shaft 85 formed of a pair of telescopic sections 86, 87, are positioned in the V-shaped notches of the mandrels and U-shaped connector members 90 with a clamping part 92 which hooks around the V-shaped notch and secures a V-shaped clamping plate 95 around the shaft to secure the same in the driven and drive mandrels. It will be noted that the mandrels and hence the shaft are positioned to one side of the table top and below the level of the same and the guide plate or plates 66 and 68 which are mounted on their respective shafts 70 and 72 and coupled together may be pivoted from a generally vertical position beneath the tables to a relatively horizontal position in which the edges of the same will underly the shafts and aid in holding the floor covering after it is moved off the edge of the table and in particular, in connection with starting the roll on the shaft. The clamping plates 95 that fit over the shafts also clamp the forward edge of the floor covering or carpet to the shaft to insure that the carpeting will roll thereon. The support members 16 and 18 of the tables 10 and 12 each have a pluralty of ground engaging screw member 100 threaded through the tapped apertures (not shown) in the frame of the end supports with suitable friction gripping surfaces 102 at the end of the same and hand cranks 104 at the top end of the same. These will be cranked into engagement with the surface upon which the tables are resting to insure agains movement of the same during operation.

The measuring and cutting machine formed of the tables 10 and 12 is held together in aligned and rigidly connected relationship through tie bars 110 which connect the legs of the end supports of the two tables, which are adjacent to one another, together. The tables are aligned through the hinge 25 so that the rollers, 35 and 65, carpeting cutting guide tube 60, and the shafts 70, 72 for the guide plates are all aligned in an assembled relationship. Also positioned on the top of the table through L-shaped mounting brackets 115 integral with frame 15 are carpet clamp down members 120 which slide over the floor covering material or carpet when it is on the table and ready for cutting. Operation of a suitable over center handle will clamp the projecting finger-like extensions 122 of the clamp down members against the carpeting holding the same against the table top 30 to insure that it will not be moved during a cutting operation.

In the operation of the measuring and cutting machine, carpet rolls from which the selected pieces are to be taken, measured and cut will be so positioned adjacent the machine that carpet from the roll will be fed across the guide rollers 35 and along the edge of the guide members 52 over the table tops 30 and through the opening in the measuring device 55. Such carpet may be supported on the yoke type carrier of a conventional type, may be positioned on a wall rack or be mounted on a suitable supporting shaft and positioned on brace members 130 having journals 135 therein to receive the shaft which fit into the backs of the tables in suitable slots therein as seen in FIG. 3. The journals 135 mount the shaft up on which the carpet roll is positioned and permits translational movement of the rolls to align the edge of the carpet with the guides 52. Where the wall mounted brackets are used, a shaped brace member 138 which slides into aperture in the frame 15 serves to space the machine from the wall racks, mobile lift or table mounted beds so that carpet may be fed from them.

Depending upon the width of the material used, one or both of the tables may be employed in the cutting machine. Where width of the floor covering material corresponds to the length of a single table, as conventionally manufactured in a 6' width, only a table 10 will be employed. Under such circumstances, the tie bars 110 will be released and removed, and the pin from the hinge 25 will be taken out allowing the separation of the tables. A special mounting leg (not shown) having a journaled mandrel thereon will be slid into suitable slots at the end of the frame or in support 18 and locked therein. Under such circumstances, only one section 86 of the shaft 85 will be used and the shaft will be clamped to the mandrels in a conventional manner.

Figure 4:
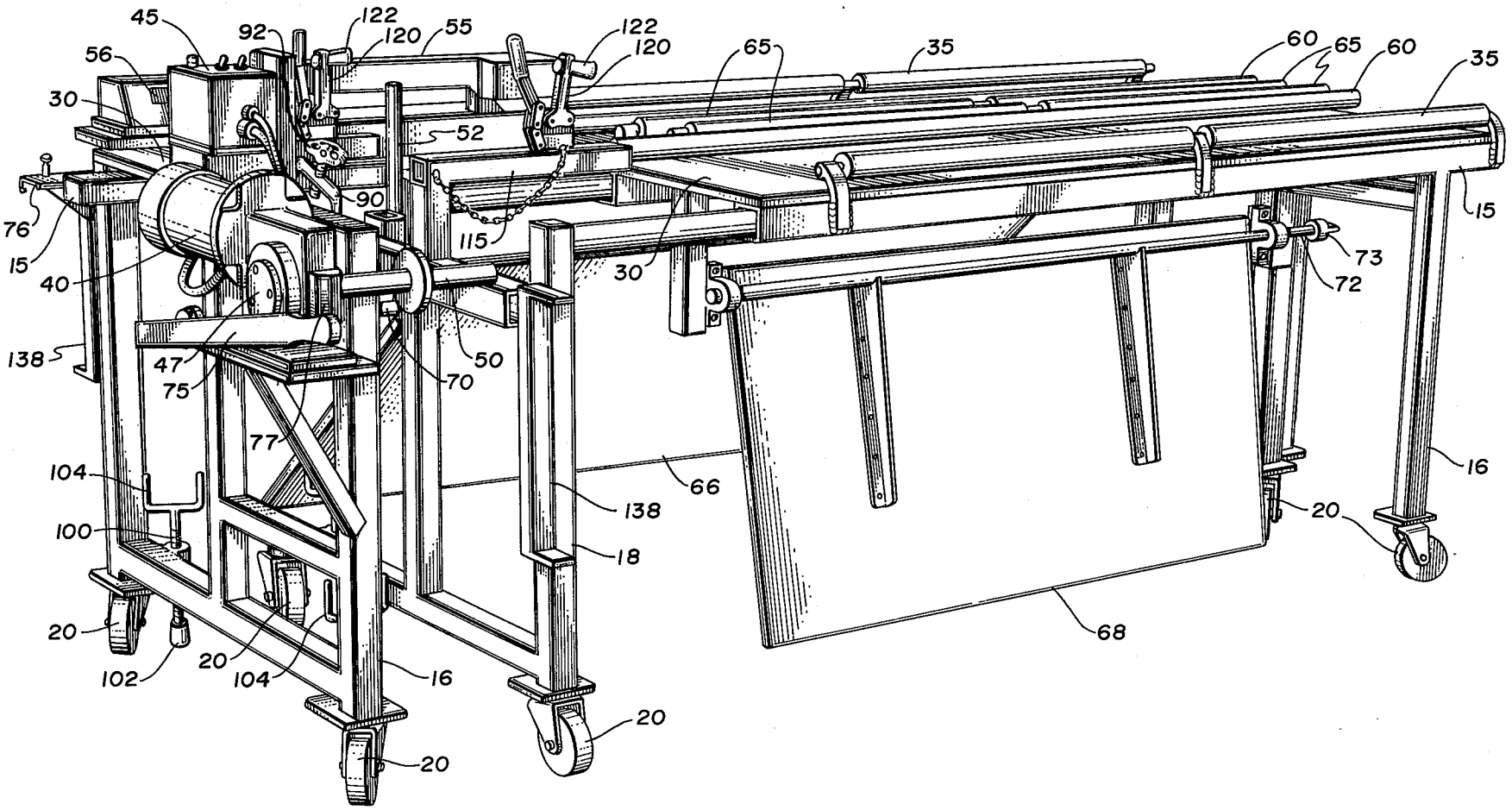
FIG. 4 is a perspective view of the machine of FIG. 1 showing the sections of the same in a pivoted condition for transport purposes.

Regardless of the support for the bulk roll, and its positioning with respect to the measuring and cutting machine, the relationship of the two will be such that the measuring and cutting machine will be rigidly secured and adapted to receive floor covering material from the roll source. In small installations, the need for handling the bulk rolls will be minimized by utilizing the portable machine which may be rolled to an adjacent location with respect to the bulk rolls of carpet, and the measuring and cutting will take place at that point. In crowded store areas, it may be necessary to disconnect the tie bars 110 and remove the shaft 85 from the machine allowing the sections to pivot through the hinge to a folded shape of FIG. 4 as the machine is moved through varying locations to a site for operation. When installed in a location for usage, carpet from the bulk roll is fed across the table tops being guided by the rollers 35 on the edge of the table tops. The carpet will be moved by hand through the measuring machine, being located by the guides on the table and pulled down into the proximity of the mandrel. The guide plates 66, 68 will be raised to be positioned below the shaft 85 and the edges of the carpet will be clamped with the shaft to the mandrels. The guide plate aids in centering the carpet on the shaft, particularly at the center location remote from the mandrel. The use of the foot mounted switch enables the operator to aid in feeding the floor covering or carpeting around the supporting shaft 85 on the mandrels as the motor 40 is energized and the mandrels rotated. The measuring indicator 56 on the measuring unit 55 will indicate the amount of carpet passing through the measuring meter. The indicator 56 is adjusted with respect to the cutting guide 60 so that measurements will be taken from the cutting guide. With continued energization of the drive motor 40, carpet is moved from the bulk roll through the measuring unit and across the tables to be wound on the take-up shaft 85 supported on the mandrels. When the desired length of carpeting has passed through the measuring device, and past the cutting guide 60, a suitable cutting tool is inserted into the guide tube 60 and drawn or pushed across the carpeting. Prior to the actual cutting, the clamp down members 120 will be moved over the floor covering and lowered to securely position the carpeting to the tables and over the cutting guide 60. A carpet cutting tool, such as is shown in our U.S. Pat. No. 3,859,725 dated Jan. 14, 1975, will be slid or otherwise drawn through the cutting guide 60 with the tool being positioned above or below the carpet or floor covering to sever the same. The guide plates 66 and 68 will normally be released and moved to a vertical position after the roll has started to form so that they will not interfere with the size of the roll as it is wound on the shaft 85 through the drive mandrel 50. Once the desired length has been cut, the portion of the floor covering on the table will be wound on the roll through continued operation of the motor. Suitable covering material may be placed over the roll and secured thereto prior to release of the shaft 85 from the mandrels. The carpet positioned on the measuring and cutting machine from the bulk rolls will be rewound back to the bulk rolls unless additional cuts are to be taken from the same material.

Figure 5:
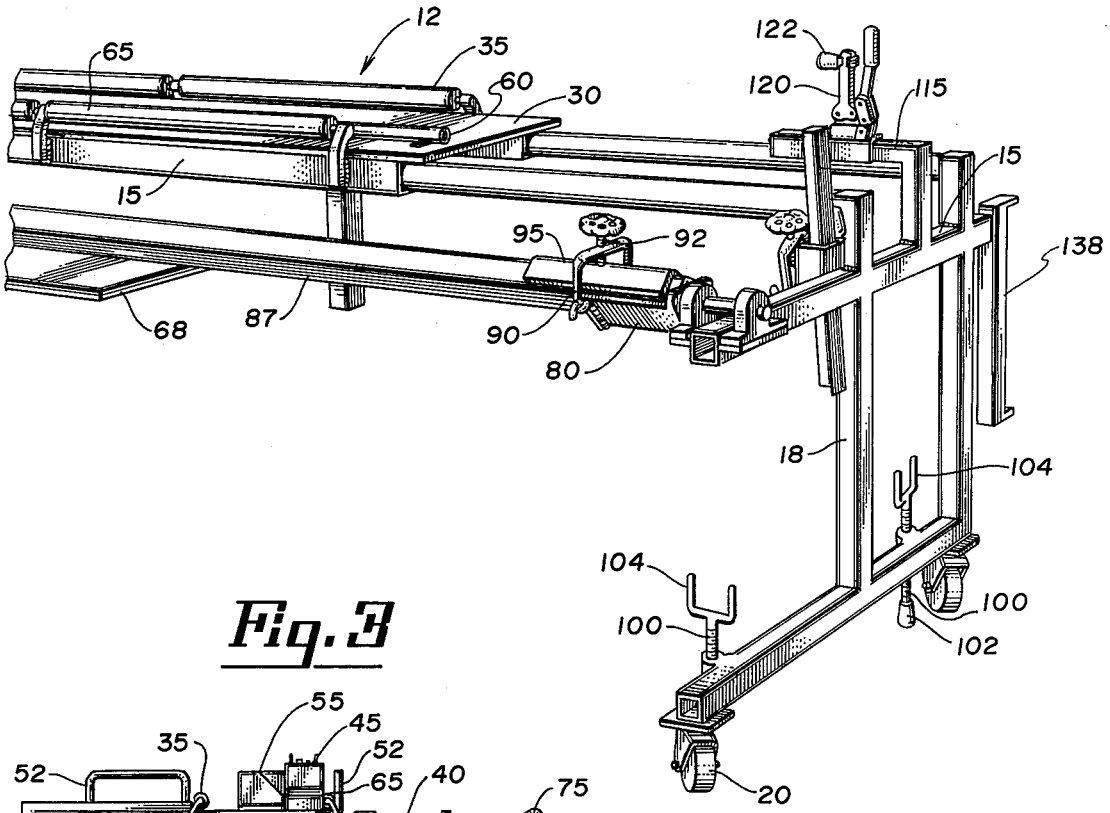
FIG. 5 is a perspective view of a portion of the machine of FIG. 1 showing the extension of the same; and, FIG. 6 is a sectional view of the machine showing an alternate embodiment of the same.

In the event that the width of the floor covering or carpet to be measured or cut exceeds the normal length of the two tables when combined, table 12 includes an extensible section, as shown in FIG. 5. Thus, when a 15 foot carpet width is to be cut and the combined tables normally handle 12 feet widths, the end support section 18 of table 12 which telescopically fits into the frame of this table is released, and extended three additional feet. The journaled mandrel is displaced with the end section or support. This portion of the end support carries the mounting bracket for the carpet clamp 120 and an extensible section (not shown) is inserted into the end of the guide tube 60 to accommodate the distance to be traveled by the cutting knife. The telescopic section does not have a table top associated therewith and is devoid of any specific guide rollers on either side of the table. However, an insert table extension with guide rollers may be employed. The shaft 85 which is formed of the two telescopic sections 86, 87 will be modified by substituting a section to accommodate the additional 3 feet length. The remainder of the structure is unchanged and the operation of the cutting and measuring table operates in the manner described above.

Figure 6:
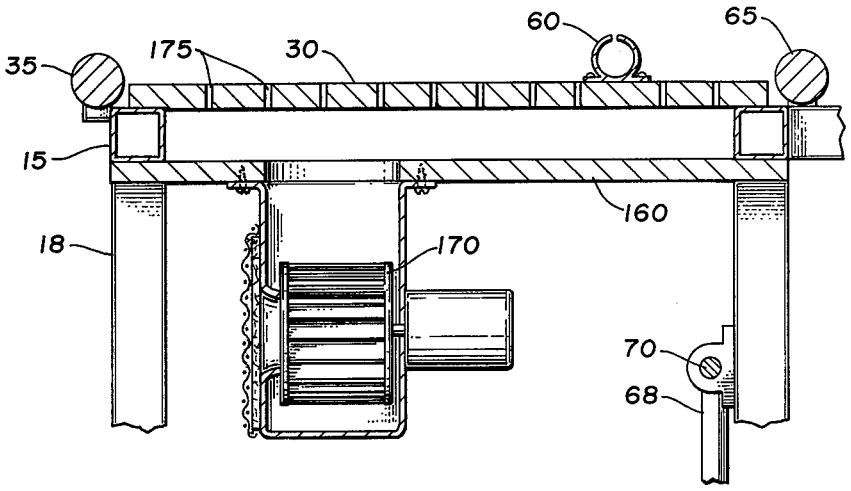

FIG. 6 shows an alternate embodiment of the measuring and cutting machine particularly designed for use with tables with wider tops and in particular, in connection with machines designed for cutting of heavier weight floor covering. It includes a floatation system associated with the table tops which is positioned between the rows of rollers on the edges of the same and extending the length of the table top for each table section. This system compensates for the weight of the material as it is initially fed across the table to facilitate the starting of the measuring operation and to aid in movement of the floor covering material on to the wind up shaft. As will be seen in the sectional view of FIG. 6, the table includes all of the structure in the before mentioned embodiment, and in addition, the table frame beneath the table top has a sealing plate 160 which encloses the frame to provide a relatively sealed chamber beneath the table top. The blower 170 is mounted on the sealing plate with a passage therethrough and the top of the table has a pluralty of apertures 175 distributed throughout the extent of the same to provide for jets of air to be emitted from the table top to aid in lifting of the floor covering material as it is moved across the same. The blower motor may be connected through a switch to a suitable outlet and in the initial movement of the carpeting across the table top, the air jets impinge on the bottom surface of the carpeting to significantly reduce the effective weight of the same. This permits a single person to feed the carpeting or floor covering material, despite its weight, through the measuring machine and along the guides to the wind up mandrels. The blower may be kept in operation during the entire measuring of the carpeting aiding in the movement of the carpeting or floor covering material across the table, or it may be deenergized after the carpeting or floor covering material is initially fed on the wind up mandrel shaft. Where two table sections are hinged together, each table section will be connected in the same manner and a separate blower will be mounted beneath each table to provide the air source for the air jets therein. The motors would be conventionally connected through the same energizing circuit to aid in the operation of the machine. Alternately, a plenum connection between the tables may be used.

The improved measuring and carpet cutting machine provides a portable structure which may be pivoted along its extent for aid in movement in crowded store room or factory locations and which may be readily moved to any desired site for cutting, minimize movement of carpet rolls and the requirement of extensive and large machinery for handling the same. Thus, the machine may be readily positioned at any desired storage point adjacent to large carpet rolls and be utilized to measure and cut required pieces of floor covering or carpet from the rolls. This eliminates the problem of moving large rolls of carpet to a cutting location when it is desired to remove selected pieces therefrom. The improved portable machine is adjustable for varying conventional carpet widths, such as 6 feet, 12 feet and 15 feet widths, and it provides a simplified arrangement for accurately measuring and cutting the carpet and retaining the selected pieces in a roll form so that they may be readily covered for shipment or delivery.

Therefore, in considering this invention, it should be remembered that the present disclosure is illustrative only and the scope of the invention should be determined by the appended claims.

What I claim is;

1. A portable floor covering measuring and cutting machine comprising: a stand having end supports with legs having wheels thereon on each end of the same and with a flat table top extending between the end supports; roller means distributed over one edge of the flat table top; drive motor means and control means therefore mounted on one end of said flat table top; a drive mandrel for mounting a shaft mounted on one end support adjacent said drive motor; a journaled mandrel mounted on the other end support; a shaft removably mounted in said mandrels and extending therebetween for rotation by the drive mandrel; said shaft and said mandrels being positioned to the side of said one edge and below the flat table top and adapted to have the floor covering rolled thereon; a guide plate pivotally mounted on said end supports and positioned below the table top to be pivoted to a position below said shaft; lever means connected to said guide plate to pivot the same; guide means positioned across the width of the table top adjacent said drive motor; measuring means positioned on the table top adjacent said guide means and cooperating with said guide means to measure floor covering moved across the table top; a cutter guide positioned on the table top adjacent the other edge of the table top; and means distributed along the table top for aiding in the movement of floor covering through the measuring device and over the table top to said shaft.

2. The floor covering measuring and cutting machine of claim 1 and including adjustable clamp down members positioned on each end of the table top and adapted to clamp the floor covering thereon for cutting.

3. The portable floor covering measuring and cutting machine of claim 1 in which the means distributed on the table top for aiding in the movement of the floor covering thereon are rollers distributed on said other edge of said table top.

4. The portable floor covering measuring and cutting machine of claim 1 in which the means distributed on the table top for aiding in the movement of floor covering thereon is an air inflation system positioned below the table top by applying jets of air through the table top.

5. The portable floor covering measuring and cutting machine of claim 1 in which the journaled and drive mandrels have V-shaped notches thereon for mounting of the shaft, and including removable clamping members for securing the shaft and floor covering thereto.

6. The portable floor covering measuring and cutting machine of claim 1 and including adjustable ground engaging friction members mounted on said end supports and adjustable to engage a surface upon which the wheels rest to prevent movement of the table when in use.

7. The portable floor covering measuring and cutting machine of claim 1 and including means on said end support adapted to position said machine from a roll from which floor covering is to be taken for measuring and cutting.

8. The portable floor covering measuring and cutting machine of claim 1 and including a second table with a stand having end supports with wheels thereon being pivotally hinged to an end support of first named table, said second table having roller means on said one edge of the table top with a cutting guide adjacent the other edge of the table top and with a pivotally mounted guide plate positioned beneath the table top, said end support remote from said pivot hinge having said journaled mandrel mounted thereon, and means releaseably connecting the end supports of the first named table and the second table common to the pivot hinge to hold the table tops with the roller means and cutting guides aligned.

9. The portable floor covering measuring and cutting machine of claim 8 in which the end support with the journaled mandrel thereon of the second table is telescopically mounted into said table stand to be extended beyond the table top with the roller guides and cutter guide thereon.

* * * * *